US007225473B2

(12) United States Patent
Schierenbeck et al.

(10) Patent No.: US 7,225,473 B2
(45) Date of Patent: Jun. 5, 2007

(54) PROTECTIVE GLOVE HAVING LEATHER FACE, LEATHER BACK, AND HEAT-RESISTANT COVER COVERING LEATHER BACK, FOR FIREFIGHTER, EMERGENCY RESCUE WORKER, OR OTHER WORKER IN HIGH-HEAT AREA

(75) Inventors: Alan W. Schierenbeck, Dayton, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/036,083

(22) Filed: Jan. 14, 2005

(65) Prior Publication Data

US 2006/0156452 A1 Jul. 20, 2006

(51) Int. Cl.
*A41D 19/00* (2006.01)

(52) U.S. Cl. ..... 2/161.6; 2/16

(58) Field of Classification Search ..... 2/161.6, 2/16, 20, 163

See application file for complete search history.

(56) References Cited

U.S. PATENT DOCUMENTS

| | | | | |
|---|---|---|---|---|
| 2,044,105 | A * | 6/1936 | Sabin | 2/8.2 |
| 2,448,697 | A * | 9/1948 | Bakke | 2/16 |
| 3,548,413 | A * | 12/1970 | Jackson | 2/16 |
| 3,760,425 | A * | 9/1973 | Komatsu | 2/169 |
| 4,918,756 | A | 4/1990 | Grilliot et al. | |
| 5,125,114 | A | 6/1992 | Grilliot et al. | |
| 5,349,705 | A * | 9/1994 | Ragan | 2/161.6 |
| 5,822,796 | A * | 10/1998 | Harges et al. | 2/161.6 |
| 6,115,850 | A | 9/2000 | Grilliot et al. | |
| 6,415,443 | B1 | 7/2002 | Schierenbeck et al. | |
| 6,427,250 | B1 | 8/2002 | Stull et al. | |
| 6,658,670 | B1 | 12/2003 | Grilliot et al. | |
| 6,839,912 | B2 | 1/2005 | Lewis | |
| 2004/0088776 | A1 | 5/2004 | Grilliot et al. | |
| 2004/0216215 | A1* | 11/2004 | Grilliot et al. | 2/159 |

OTHER PUBLICATIONS

International Search Report from PCT/US06/01079.
Written Opinion of the International Searching Authority from PCT/US06/01079.

* cited by examiner

*Primary Examiner*—Katherine Moran
(74) *Attorney, Agent, or Firm*—Wood, Phillips, Katz, Clark & Mortimer

(57) ABSTRACT

In a protective glove for a firefighter, an emergency rescue worker, or another worker in a high-heat area, a leather face has a peripheral edge, a leather back has a peripheral edge, a leather forchette has a peripheral edge sewn to the peripheral edge of the leather face and a peripheral edge sewn to the peripheral edge of the leather back, and a heat-resistant cover made from an aramid or polybenzamidazole fabric has a peripheral edge sewn to the peripheral edge of the leather back. The heat-resistant cover covers the leather back so as to protect the leather back against direct exposure to high heat that would tend to shrink the leather back if the leather back were not protected by the heat-resistant cover.

12 Claims, 1 Drawing Sheet

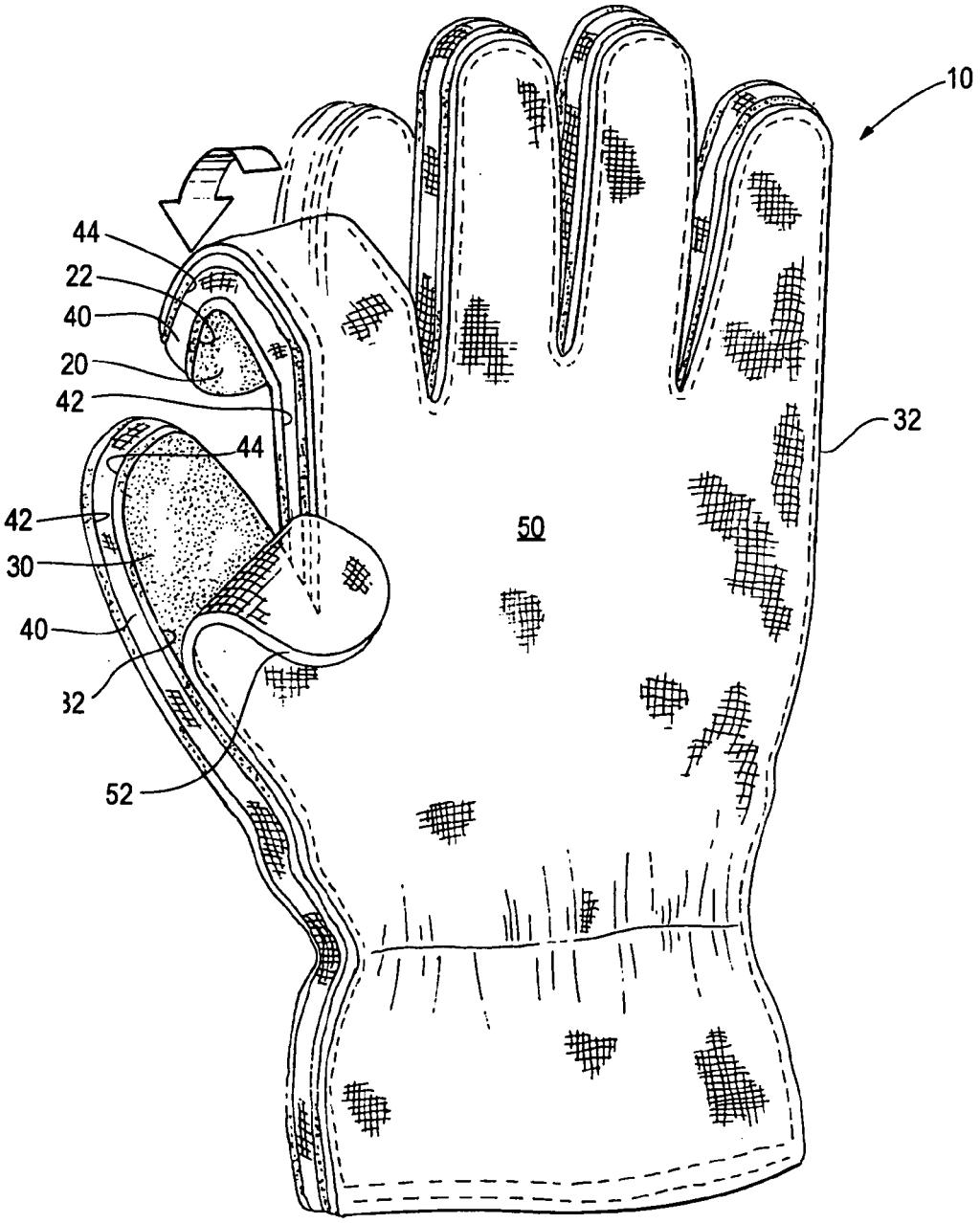
10
44
22
40
20
42
44
42
30
40
32
52
50
32

PROTECTIVE GLOVE HAVING LEATHER FACE, LEATHER BACK, AND HEAT-RESISTANT COVER COVERING LEATHER BACK, FOR FIREFIGHTER, EMERGENCY RESCUE WORKER, OR OTHER WORKER IN HIGH-HEAT AREA

TECHNICAL FIELD OF THE INVENTION

This invention pertains to a protective glove for a firefighter, an emergency rescue worker, or another worker in a high-heat area, wherein the protective glove has a leather face, a leather back, and, possibly, a leather forchette.

BACKGROUND OF THE INVENTION

Conventionally, a protective glove for a firefighter, an emergency rescue worker, or another worker in a high-heat area has an outer shell, which is made from a suitable leather, such as cowhide or elkhide, and which comprises a leather face having a peripheral edge, a leather back having a peripheral edge, and a leather forchette. When the protective glove is worn, the leather face is worn over the palm of the wearer's hand, the leather back is worn over the back of the wearer's hand, and the leather forchette separates the leather face and the leather back.

The leather forchette has a peripheral edge, which is sewn to the peripheral edge of the leather face and a peripheral edge sewn to the peripheral edge of the leather back. In a protective glove of a simpler construction, the leather forchette is omitted and the peripheral edge of the leather back is sewn to the peripheral edge of the leather face.

Conventionally, whether or not the leather forchette is utilized, the protective glove has an intermediate liner providing a moisture barrier, or a moisture and chemical barrier, and an inner liner providing thermal insulation. When the protective glove is worn, air within the protective glove also provides thermal insulation.

Although an outer shell made from a suitable leather, such as cowhide or elkhide, provides multiple advantages including puncture resistance, abrasion resistance, and flexibility, an outer shell made from such a leather has an undesirable tendency to shrink around the wearer's hand, whereby to drive insulative air from the protective glove, when the outer shell is exposed to high heat, particularly at the leather back.

SUMMARY OF THE INVENTION

This invention provides, for a firefighter or for an emergency rescue worker, a protective glove having an outer shell, which comprises a leather face, which further comprises a leather back having a peripheral edge and being attached to the leather face, and which further comprises a heat-resistant, flexible, fabric cover covering at least a portion or at least portions of the leather back so as to protect the covered portion or covered portions of the leather back against direct exposure to high heat that would tend to shrink the covered portion or covered portions of the leather back if the covered portion or covered portions of the leather back were not protected by the heat-resistant cover. Preferably, the leather back in its entirety is covered by the heat-resistant cover. Preferably, a peripheral edge of the heat-resistant cover is sewn to a peripheral edge of the leather back. Preferably, the heat-resistant cover is made from an aramid or polybenzamidazole fabric.

In a preferred embodiment of this invention, the protective glove has an outer shell, which comprises a leather face having a peripheral edge, which further comprises a leather back having a peripheral edge, which further comprises a leather forchette having two peripheral edges, one said edge of the leather forchette being sewn to the peripheral edge of the leather face and the other edge of the leather forchette being sewn to the peripheral edge of the leather back, and which further comprises a heat-resistant cover, as described in the preceding paragraph. Here, again, the heat-resistant cover covers at least a portion or at least portions of the leather back so as to protect the covered portion or covered portions of the leather back against direct exposure to high heat that would tend to shrink the covered portion or covered portions of the leather back if the covered portion or covered portions of the leather back were not protected by the heat-resistant cover. Preferably, again, the leather back in its entirety is covered by the heat-resistant cover. Preferably, again, a peripheral edge of the heat-resistant cover is sewn to a peripheral edge of the leather back. Preferably, again, the heat-resistant cover is made from an aramid or polybenzamidazole fabric.

BRIEF DESCRIPTION OF THE DRAWING

The sole FIGURE is a back elevation of a protective glove constituting a preferred embodiment of this invention. The index finger of the protective glove is curled, as indicated by a curved arrow, so as to reveal a leather face of the protective glove. At the thumb of the protective glove, a portion of a heat-resistant cover is peeled back, so as to reveal a leather back of the protective glove.

DETAILED DESCRIPTION OF THE ILLUSTRATED EMBODIMENT

As illustrated, a protective glove 10 for a firefighter or for an emergency rescue worker has an outer shell, which is made from a suitable leather, such as cowhide or elkhide, and which comprises a leather face 20 having a peripheral edge 22, a leather back 30 having a peripheral edge 32, and a leather forchette 40 having a front peripheral edge 42 and having a back peripheral edge 44. When the protective glove 10 is worn, the leather face 20 is worn over the palm of the wearer's hand, the leather back 30 is worn over the back of the wearer's hand and the leather forchette 40 separates the leather face and the leather back.

The front peripheral edge 42 of the leather forchette 40 is sewn to the peripheral edge 22 of the leather face 20. The back peripheral edge 44 of the leather forchette 40 is sewn to the peripheral edge 32 of the leather back 30. In a simplified embodiment, which is not illustrated, the leather forchette 40 is omitted and the peripheral edge 32 of the leather back 30 is sewn to the peripheral edge 22 of the leather face 20.

Additionally, whether or not the leather forchette 40 is utilized, the protective glove 10 may have an intermediate liner (not illustrated) providing a moisture barrier, or a moisture and chemical barrier, and an inner liner (not illustrated) providing thermal insulation. When the protective glove 10 is worn, air within the protective glove 10 also provides thermal insulation.

As provided by this invention, whether or not the leather forchette 40 is utilized, a heat-resistant cover 50 having a peripheral edge 52 sewn to the peripheral edge 32 of the leather back 30. If the leather forchette 40 is utilized, the peripheral edge 52 of the heat-resistant cover 50 is sewn also to the back peripheral edge 44 of the leather forchette 40.

Preferably, the heat-resistant cover is made from an aramid fabric, such as a Nomex™ or Kevlar™ fabric, or from a polybenzamidazole fabric, which may be otherwise called a PBI fabric. Conventionally, such fabrics are used to make outer shells of protective garments, such as coats and trousers, for firefighters.

In the embodiment illustrated in the drawing and described hereinabove, the heat-resistant cover 50 covers the leather back 30 in its entirety. Thus, the heat-resistant cover protects the leather back 30 in its entirety against direct exposure to high heat that would tend to shrink the leather back 30 in its entirety if the leather back 30 in its entirety were not protected by the heat-resistant cover 50.

In alternative embodiments, the heat-resistant cover 50 does not cover the leather back 30 in its entirety but covers a portion or portions of the leather back 30, such as the broad portion illustrated below the thumb and fingers in the drawing or the portions covering the thumb and fingers. Thus, the heat-resistant cover protects the covered portion or covered portions of the leather back 30 against direct exposure to high heat that would tend to shrink the covered portion or covered portions of the leather back 30 if the covered portion or covered portions of the leather back 30 were not protected by the heat-resistant cover 50.

The invention claimed is:

1. For a firefighter, an emergency rescue worker, or another worker in a high-heat area, a protective glove having an outer shell, which comprises a leather face, a leather back having a peripheral edge and being attached to the leather face, and a heat-resistant, flexible, fabric cover covering, externally, at least a portion or at least portions of the leather back so as to protect the covered portion or covered portions of the leather back against direct exposure to high heat that would tend to shrink the covered portion or covered portions of the leather back if the covered portion or covered portions of the leather back were not protected by the heat-resistant cover.

2. The protective glove of claim 1, wherein the leather back in its entirety is covered by the heat-resistant cover.

3. The protective glove of claim 1, wherein the heat-resistant cover is made from an aramid or polybenzamidazole fabric.

4. The protective glove of claim 2, wherein the heat-resistant cover is made from an aramid or polybenzamidazole fabric.

5. For a firefighter, an emergency rescue worker, or another worker in a high-heat area, a protective glove having an outer shell, which comprises a leather face, a leather back having a peripheral edge and being attached to the leather face, and a heat-resistant cover having a peripheral edge sewn to the peripheral edge of the leather back, the heat-resistant, flexible, fabric cover covering, externally, at least a portion or at least portions of the leather back so as to protect the covered portion or covered portions of the leather back against direct exposure to high heat that would tend to shrink the covered portion or covered portions of the leather back if the covered portion or covered portions of the leather back were not protected by the heat-resistant cover.

6. The protective glove of claim 5, wherein the leather back in its entirety is covered by the heat-resistant cover.

7. The protective glove of claim 5, wherein the heat-resistant cover is made from an aramid or polybenzamidazole fabric.

8. The protective glove of claim 6, wherein the heat-resistant cover is made from an aramid or polybenzamidazole fabric.

9. For a firefighter, an emergency rescue worker, or another worker in a high-heat area, a protective glove having an outer shell, which comprises a leather face having a peripheral edge, a leather back having a peripheral edge, a leather forchette having two peripheral edges, one said edge of the leather forchette being sewn to the peripheral edge of the leather face and the other edge of the leather forchette being sewn to the peripheral edge of the leather back, and a heat-resistant, flexible, fabric cover having a peripheral edge sewn to the peripheral edge of the leather back, the heat-resistant cover coverings, externally, at least a portion or at least portions of the leather back so as to protect the leather back against direct exposure to high heat that would tend to shrink the covered portion or covered portions of the leather back if the covered portion or covered portions of the leather back were not protected by the heat-resistant cover.

10. The protective glove of claim 9, wherein the leather back in its entirety is covered by the heat-resistant cover.

11. The protective glove of claim 9, wherein the heat-resistant cover is made from an aramid or polybenzamidazole fabric.

12. The protective glove of claim 11, wherein the heat-resistant cover is made from an aramid or polybenzamidazole fabric.

* * * * *